US008406445B1

(12) United States Patent
Arneson et al.

(10) Patent No.: US 8,406,445 B1
(45) Date of Patent: Mar. 26, 2013

(54) LOUDSPEAKER SYSTEM WITH EXTENDED CONSTANT VERTICAL BEAMWIDTH CONTROL

(75) Inventors: Jon M. Arneson, Napa, CA (US); Paul Kohut, Napa, CA (US); John D. Meyer, Berkeley, CA (US); Pablo Espinosa, Pleasanton, CA (US); Richard D. Herr, Berkeley, CA (US)

(73) Assignee: Meyer Sound Laboratories, Incorporated, Berkeley, CA (US)

( * ) Notice: Subject to any disclaimer, the term of this patent is extended or adjusted under 35 U.S.C. 154(b) by 86 days.

(21) Appl. No.: 12/896,363

(22) Filed: Oct. 1, 2010

Related U.S. Application Data

(60) Provisional application No. 61/247,845, filed on Oct. 1, 2009.

(51) Int. Cl.
*H04R 1/20* (2006.01)
*H04R 1/02* (2006.01)

(52) U.S. Cl. ..... 381/340; 381/338

(58) Field of Classification Search ..... 381/59, 381/79, 160, 182, 186, 335–340, 642; 181/152, 181/159, 187, 192, 195, 199
See application file for complete search history.

(56) References Cited

U.S. PATENT DOCUMENTS

| | | | | |
|---|---|---|---|---|
| 6,513,622 | B1 * | 2/2003 | Gelow et al. | 181/152 |
| 7,367,423 | B2 * | 5/2008 | Ferrell et al. | 181/187 |
| 2009/0214067 | A1 * | 8/2009 | Bothe | 381/339 |
| 2009/0226019 | A1 * | 9/2009 | Koren et al. | 381/345 |

* cited by examiner

*Primary Examiner* — Brian Ensey
(74) *Attorney, Agent, or Firm* — Donald L. Beeson; Beeson Skinner Beverly, LLP

(57) ABSTRACT

A loudspeaker system has a high frequency channel for driving a horn loaded high frequency transducer, and a low frequency channel for driving a low frequency transducer. A signal processing circuit is provided which has at least one first order and at least one second order cross-over circuit portion in the high channel and at least one first order and at least one second order cross-over circuit portion in the low frequency channel. These cross-over portions produce a cross-over frequency range for the loudspeaker system that is below the cut-off frequency of the horn. The signal processing circuit, including its cross-over circuit portions and in conjunction with the design of the expansion walls of the horn, extends vertical beamwidth control of the acoustic output of the loudspeaker system at the loudspeaker system's lower frequency range.

19 Claims, 10 Drawing Sheets

LOUDSPEAKER SYSTEM WITH EXTENDED CONSTANT VERTICAL BEAMWIDTH CONTROL

CROSS-REFERENCE TO RELATED APPLICATIONS

This application claims the benefit of U.S. provisional application No. 61/247,845 filed Oct. 1, 2009, which is incorporated herein by reference.

FIELD OF THE INVENTION

The present invention generally relates to loudspeaker systems and more particularly to full range directional loudspeaker systems. The invention has particular application in cinema sound reinforcement systems.

BACKGROUND

A common goal in loudspeaker system design is to achieve a constant beamwidth, or directivity, in both the horizontal and vertical planes over the loudspeaker's operating frequency range. Often the desired beamwidth in the horizontal plane is kept relatively wide (70 to 100 degrees) in order to direct sound uniformly over the width of the room or audience from a single acoustic point. Within this range, the desired horizontal beamwidth will depend on the width of the room, reflective properties of walls in the room, and the location of the loudspeaker. For example, a horizontal beamwidth at the low end of the range will avoid destructive acoustic reflections from nearby walls in the room, whereas a horizontal beamwidth on the high end of the range can be used where the walls of the room are acoustically absorbent or not in destructive proximity to the sound field. In either case, it is desirable to create a beam of sound having a horizontal beamwidth that meets the room conditions but yet is sufficiently large to cover the entire audience to its outer edges over the operating frequency range of the loudspeaker.

To accommodate different room conditions two different horizontal beamwidths are sometimes offered in a loudspeaker system. This is accomplished by providing two different waveguide horns, either of which can be installed into the loudspeaker enclosure. In that case the waveguide horns are kept similar in all respects except for the shape of the horizontal expansion of the horn. The horns with different horizontal expansions produce polar patterns with different horizontal beamwidths, and can be designed to produce horizontal beamwidths in a range between 70 to 100 degrees.

The desired beamwidth in the vertical plane is usually a much smaller angle than the horizontal. This is because the depth of the seating for an audience as seen by the loudspeaker is normally relatively shallow and only requires a relatively small vertical beamwidth angle to achieve the desired coverage. A vertical beamwidth of 40 to 50 degrees is often desired to concentrate acoustic energy to the audience and prevent acoustic energy from spreading elsewhere in the room.

Beamwidth is typically defined as the angle at which the magnitude of the acoustic pressure wave is 6 dB lower than the measured pressure on-axis to the loudspeaker. It is understood by those of ordinary skill in the art that, if the pressure has not attenuated more than 6 dB over a range of seats, the sound will generally be observed as similar to the on-axis response, provided a large portion of the frequency band attenuates equally. This is considered uniform coverage in the field of acoustics.

To obtain this goal, the beamwidth must be kept constant over the widest possible range of frequencies. In a two way loudspeaker system a crossover is used to split the full range audio signal into a high frequency channel and a low frequency channel. The high frequency channel uses a waveguide horn to control the vertical and horizontal beamwidth. To obtain a wide range of frequencies where the beamwidth is kept constant, the waveguide horn is made large to work well at long wavelengths and the crossover frequency is set at a relatively low frequency. A dimension of 24 inches by 48 inches at the face of the horn is not uncommon to obtain directional control down to 1000 Hz. When the angle of beamwidth control is small, such as 40 degrees as required in the vertical plane, the horn must be made physically deeper and larger to obtain control at the lower end of its operating frequency range.

The above-mentioned approaches to achieving beamwidth control in a waveguide horn have significant drawbacks certain applications, and particularly in cinema applications. In cinemas applications the loudspeakers are placed behind a cinema screen, and using loudspeakers having large or deeper waveguide horns can detrimentally affect the beamwidth and frequency response of the loudspeaker system due to waves reflecting back and forth between the screen and the surface of the horn. Reflections from the back of the cinema screen propagate back onto the walls of the horn causing the sound waves to reflect in undesirable directions. Sometimes referred to as beam spreading, this phenomenon degrades beamwidth control. The present invention overcomes the drawbacks of these previous approaches by permitting the use of a smaller horn behind a cinema screen while maintaining the desired beamwidth control in the vertical and horizontal directions. Because of this, the affect of the screen on the system's frequency response and beamwidth control over a range of frequencies is substantially reduced or eliminated.

SUMMARY OF INVENTION

The present invention is directed to an at least two-way loudspeaker system comprised of a high channel transducer attached to a waveguide horn, a low channel cone transducer mounted in close proximity above or below the high channel waveguide, both of which are mounted in an enclosure, which can be either a sealed or vented enclosure for operating the low channel transducer over a suitable frequency range. A high channel signal processing circuit and a low channel signal processing circuit are provided to control the relative phase and magnitude of the acoustic waves propagating from each transducer. The high channel processing circuit and low channel processing circuit are designed to allow the horn to operate below its normal cut-off frequency, that is, below the point where, due to its physical size, the horn would cease being directional (for example, around 1.5 kHz). The signal processing circuits for the hi and low channels also control the beamwidth of the combined acoustic outputs of the horn and cone driver in a frequency range below the horns normal inherent cut-off frequency, for example, down from 1.5 kHz down to about 500 Hz. The result is a full range loudspeaker system having a controlled beamwidth over substantially its entire frequency range.

The invention can be practiced in different audio frequency bands by selecting and appropriately scaling all the physical geometries of the horn and transducers and signal processing. For example, the horn of the loudspeaker system can be physically designed to provide constant horizontal and vertical beamwidth control from the highest audible frequencies (approximately 15 kHz) down to the mid audio frequencies (approximately 1.5 kHz), with a wide horizontal beamwidth (for example, approximately 100 degrees), and narrow vertical beamwidth (for example, approximately 50 degrees). The waveguide horn can then combined with signal processing, a low channel transducer, and an enclosure to produce an extended low frequency narrow beamwidth (down to about 500 Hz), which is otherwise not achievable by the waveguide horn alone.

DESCRIPTION OF THE ILLUSTRATED EMBODIMENT

Figure 1A:
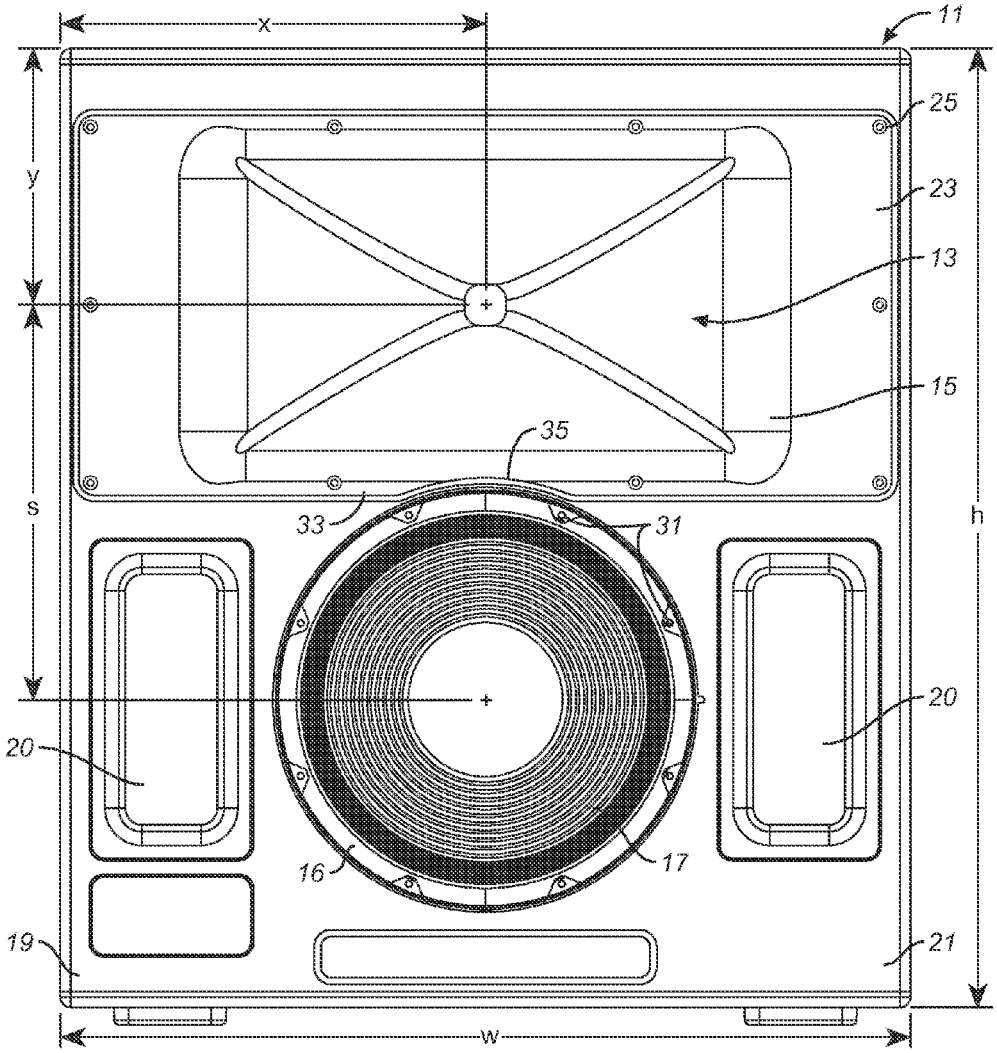
FIG. 1A is a front elevational view of a two-way loudspeaker having a closely space horn and low frequency driver.
Figure 1B:
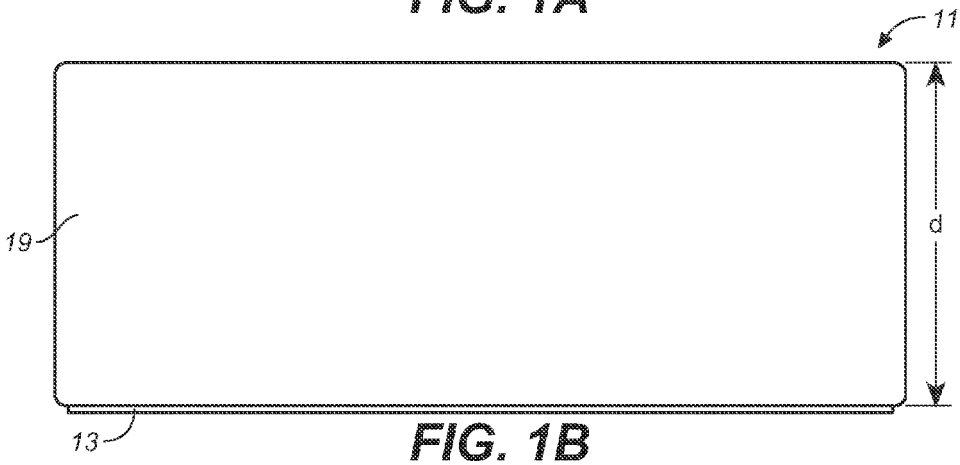
FIG. 1B is a top plan view thereof.

Referring now to the drawings, FIGS. 1A and 1B show a two-way loudspeaker system, generally denoted by the numeral 11, comprised of a horn 13 (illustrated in more detail in FIGS. 2A-2C) having a mouth end 15 and a low frequency transducer in the form of a cone driver 17, both of which are mounted in a ported enclosure 19 having a front baffle wall 21. More particularly, it is seen that the mouth end of the horn can have an outer flange 23 for mounting the horn to the enclosure's front baffle wall by suitable fastening means, such as mounting screws 25, so that the mouth end of the horn lies substantially in the plane of the baffle wall. Similarly, the low frequency cone driver can be mounted to the baffle wall via a perimeter rim 16 using suitable fasteners such as mounting screws 31.

The horn 13 and low driver 17 are mounted to the front baffle wall of the enclosure in close proximity to each other. Selection of the spacing between the horn axis and the center of the cone driver is important to the ability to extend control over the beamwidth of the horn down into lower frequency ranges. Generally, where the spacing is too great, the ability to control beamwidth at lower frequencies with signal processing as described below will be lost. If the spacing is too close, distortion will be introduced into the acoustic output of the loudspeaker. To permit an optimal axis-to-center spacing that might not otherwise be possible due to mechanical interference between parts, the lower edge 33 of the mouth of horn 13, which includes outer horn's flange 23, can be provided with a cut-out 35 into which the perimeter rim 16 of the cone driver can be fitted. Preferably, this perimeter rim has a radius that conforms to the radius of the cone driver's perimeter rim.

It can be seen that the ported loudspeaker enclosure shown in FIGS. 1A and 1B is relatively compact. The ports 20 of the enclosure 19 can be provided in the available space on the enclosure baffle wall on either side of low driver 17.

Figure 2B:
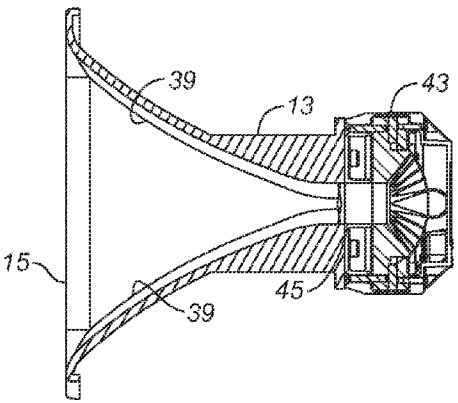
FIG. 2B is a to-scale cross-sectional view thereof taken along lines 2B-2B in FIG. 1, and additionally showing a compression driver mounted to the throat end of the horn.
Figure 2A:
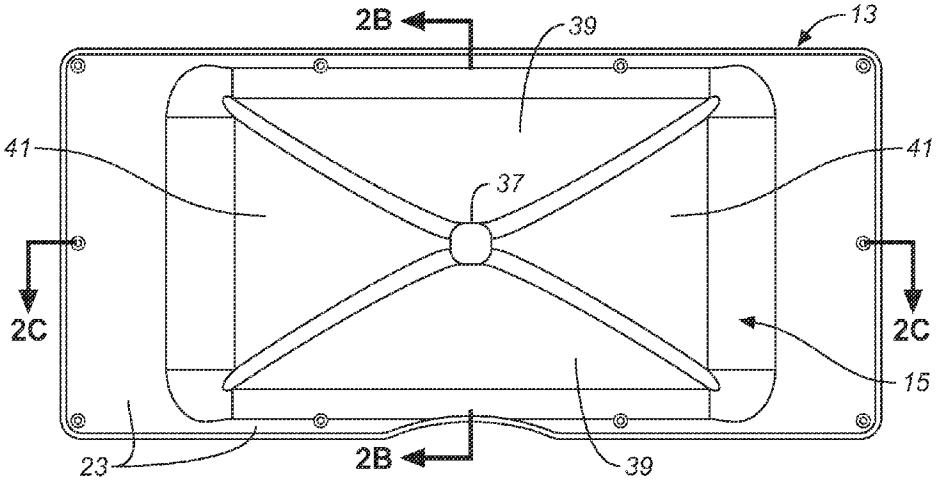
FIG. 2A is a to-scale front elevational view of an exemplary waveguide horn used in the loudspeaker shown in FIG. 1.

FIGS. 2A-2B illustrate in greater detail the waveguide horn 13 of the two-way loudspeaker system shown in FIG. 1. The horn, which can suitably be constructed from rigid plastic material, has a throat end 37 and vertical and horizontal expansion walls 39, 41, terminating at the horn's mouth end 15. As shown in FIG. 2B, a high frequency compression driver 43 is coupled to the horn's throat end 37 for delivering acoustic energy to the throat end of the horn. The size of the opening 45 of the compression driver suitably matches the size of horn's throat opening, which in the illustrated embodiment is 1.5 inches.

The shape (curvature) and size of the vertical and horizontal expansion walls 39, 41 of horn 13 will control the horn's inherent vertical and horizontal beamwidth over portions of the operating frequency range above the horn's inherent vertical and horizontal beamwidth cut-off frequencies. As used herein, the inherent (or normal) horizontal beamwidth cut-off frequency is the lowest frequency the horn can operate by itself before there is a loss of horizontal beamwidth control. The inherent vertical beamwidth cut-off frequency is the lowest frequency at which the horn can operate by itself before there is a loss of vertical beamwidth control. While cut-off frequencies cannot be precisely determined, they can established qualitatively by looking at beamwidth versus frequency graphs generated by acoustic measurements of the horn by itself outside of an enclosure and without signal processing.

Figure 2C:
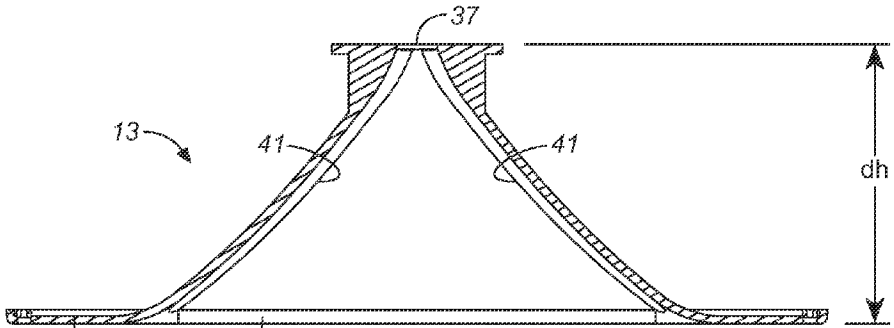
FIG. 2C is another to-scale cross-sectional view thereof taken along lines 2C-2C in FIG. 1.
Figure 3:
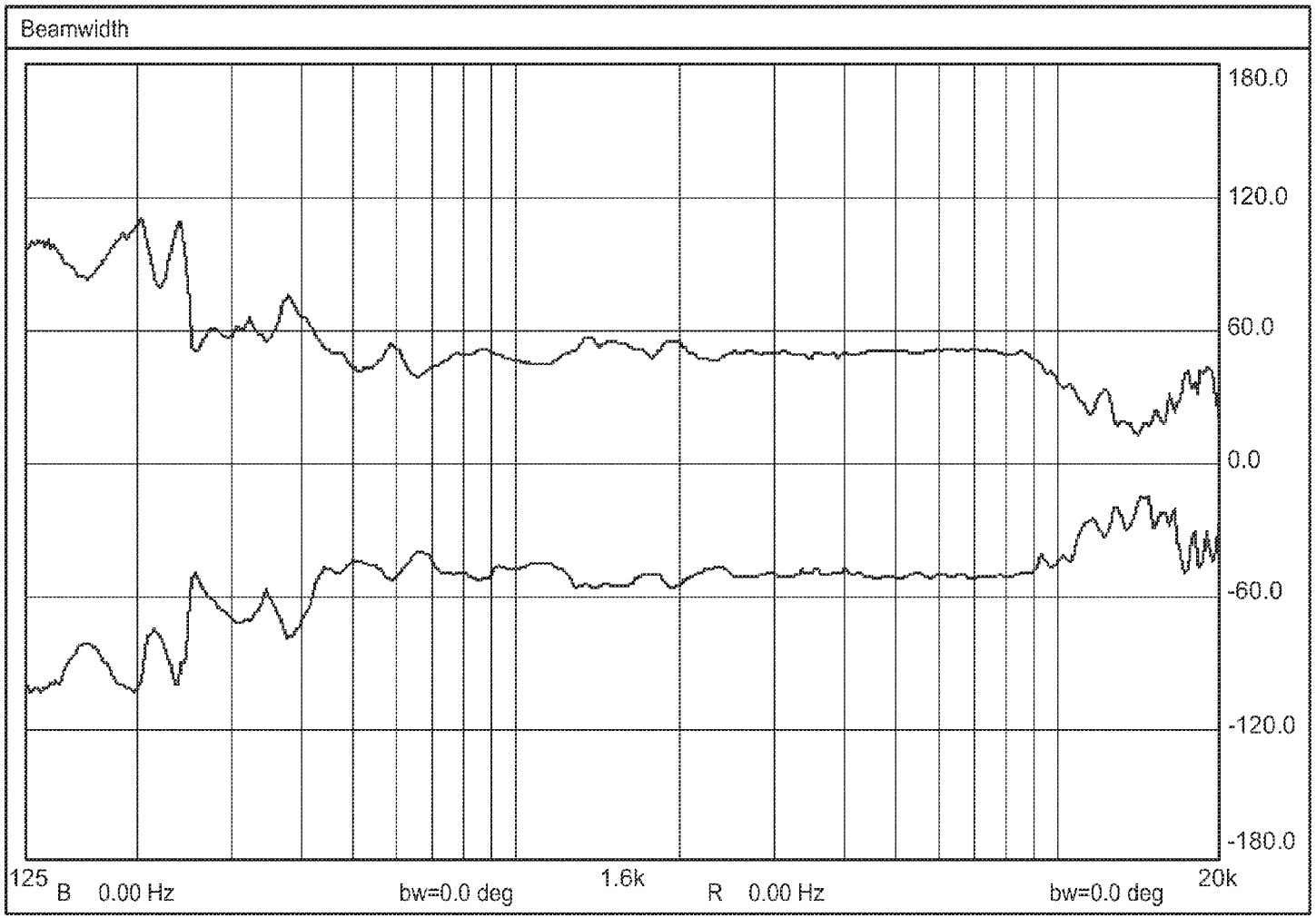
FIG. 3 is a graph of the inherent horizontal beamwidth of the exemplary waveguide horn shown in FIGS. 2A-2C having a depth of 10.2 inches, wherein beamwidth versus frequency is measured with by horn outside the enclosure over an operating frequency range without signal processing or crossover.

The performance of the horn can further be described in reference to the to-scale exemplary horn shown in FIGS. 2A-2C, which has a depth, denoted "dh" in FIG. 2C. The expansion shapes and size of vertical walls 41 are chosen to allow a relatively constant horizontal beamwidth of 100 degrees from 15 kHz down to 600 Hz. The graph in FIG. 3 shows this result. (Generally, the expansion shape and size of the vertical walls would control the horizontal beamwidth, however, changes in the horizontal expansion walls could produce edge effects that alter the horizontal beamwidth at certain frequencies. The reverse is true when designing the horizontal expansion walls to control the vertical beamwidth as discussed below.) FIG. 3 shows the inherent horizontal beamwidth of the horn by itself, that is, driven by the compression driver 43 alone without signal processing. The y-axis of the graph is the angle on either side of the center axis of the horn where the response is 6 dB below the on-axis response. It is shown as + and − degrees relative to the center axis. The designated beam-width at a particular frequency is the total angle between the +/−6 dB points at the frequency indicated on the graph's horizontal axis.

The expansion shape and size of the horizontal expansion walls 39 can similarly be chosen to allow for a relatively constant vertical beamwidth above the inherent cut-off frequency for the horn's vertical beamwidth. Here, the depth of the horn, denoted "dh" in FIG. 2C, will determine the vertical beamwidth cut-off frequency.

With respect to the exemplary horn mentioned above, FIG. 4 shows the vertical beamwidth of the horn versus frequency. It is seen that in the vertical plane the beamwidth remains relatively constant at 50 degrees from 15 kHz down to approximately 1.5 kHz. Because the vertical beamwidth of the exemplary horn begins to increase below 1.5 kHz, a horn having the size of the exemplary horn would normally be considered to have a cut-off frequency of 1.5 kHz. There are numerous types of shapes and horn expansions that can be used to obtain similar beamwidth behavior. However, within the size limits of the horn shown in FIGS. 2A-2C it is normally not possible to obtain a significantly lower cut-off frequency than 1.5 kHz where a 50 degrees vertical beamwidth is maintained. Heretofore, larger horns had to be used to obtain better vertical beamwidth control at lower frequencies. As above-mentioned, using larger horns has a number of drawbacks including restrictions on possible placement and fit in confined areas such as behind a cinema screen, as well as greater front surface area. In cinema applications, where the loudspeaker is placed closely behind the cinema screen, this increase in size can cause multiple reflections and subsequent cancellations.

Figure 4:
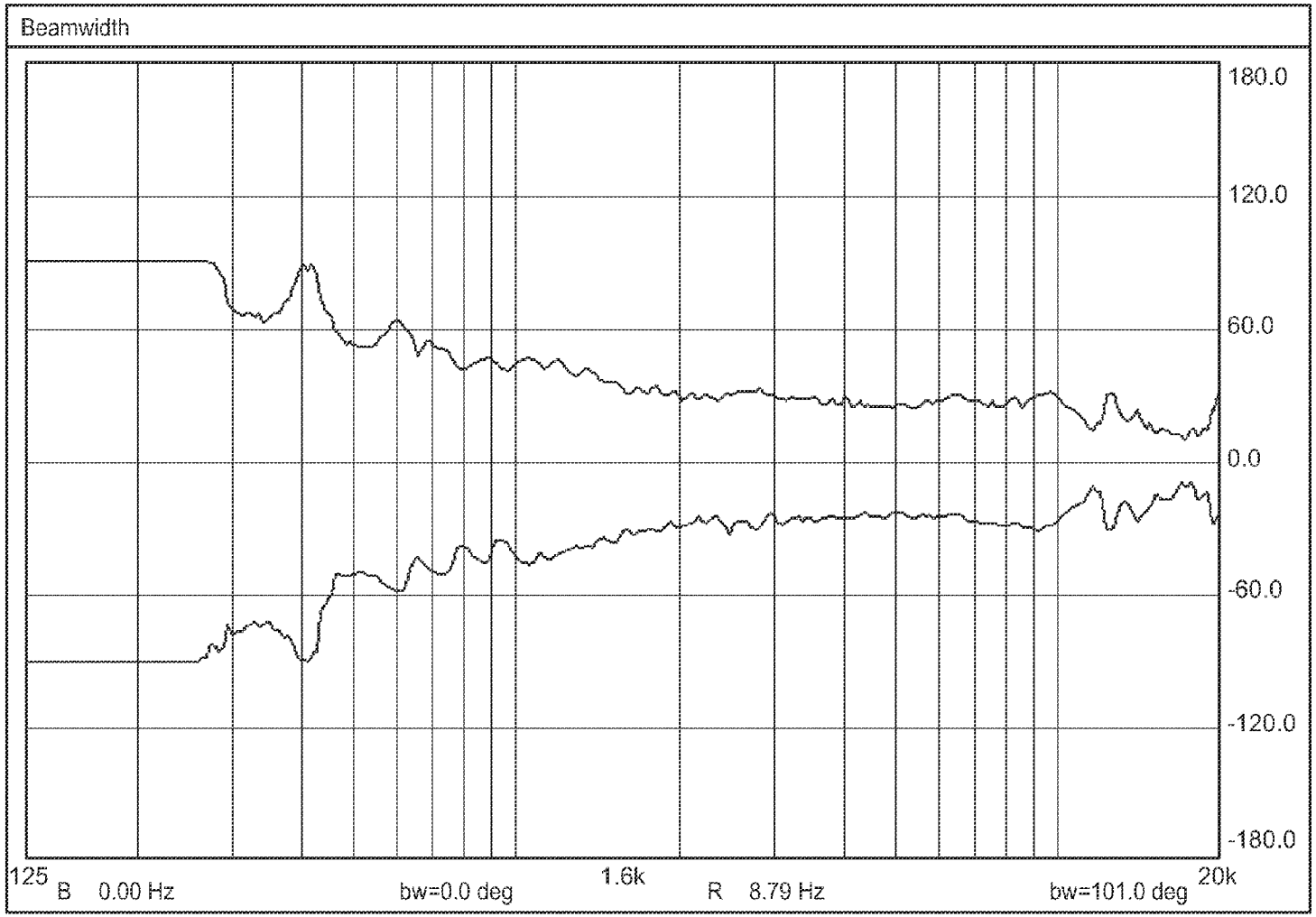
FIG. 4 is a graph of the inherent vertical beamwidth of the waveguide exemplary horn shown in FIGS. 2A-2C having a depth of 10.2 inches, wherein beamwidth versus frequency is measured with by horn outside the enclosure over an operating frequency range without signal processing or crossover.

Further referring to the beamwidth versus frequency plot in FIG. 4, it can be seen that the vertical beamwidth begins to increase (widen) progressively below 1.5 kHz. By 1 kHz the beamwidth has almost doubled to 100 degrees, and by 600 Hz the beamwidth is approximately 120 degrees yielding much less vertical control in the acoustic environment. This is typical behavior of prior art loudspeakers that are similarly sized and that have a similarly sized horn.

To obtain extended vertical beamwidth control down to lower frequencies, the low frequency transducer 17 of the loudspeaker 11 shown in FIG. 1 is caused to operate and interact with the high frequency waveguide horn 13 with signal processing. The acoustical performance of the complete loudspeaker system, as illustrated in FIGS. 1A and 1B and as controlled by the hereinafter described signal processing, is now described in reference to an exemplary loudspeaker system having the above described exemplary horn with a depth of 10.2 inches and the following additional characteristics and dimensions (denoted on FIGS. 1A and 1B):

| | |
|---|---|
| Low frequency driver (17): | 15 inch cone driver |
| Enclosure dimensions: | width (w) = 31 inches |
| | height (h) = 35 inches |
| | depth (h) = 21 inches |
| Horn locating dimensions: | x = 15.5 inches |
| | y = 9.38 inches |
| Horn axis to driver center spacing: | s = 14.37 inches |

The above horn axis to driver center spacing (s) was determined empirically and was chosen because it provided a spacing between the horn 13 and cone driver 15 that allowed the greatest control over the vertical beamwidth of the horn below the horns natural cut-off frequency using signal processing. Because this spacing causes the rim of the cone driver to overlap the horn's lower edge 33, the lower edge is provided with cut-out 35 as above described. It is contemplated that in most cases of a two-way loudspeaker system in accordance with the invention, the spacing (s) between the low transducer and waveguide horn will be less than 15 inches.

Figure 5:
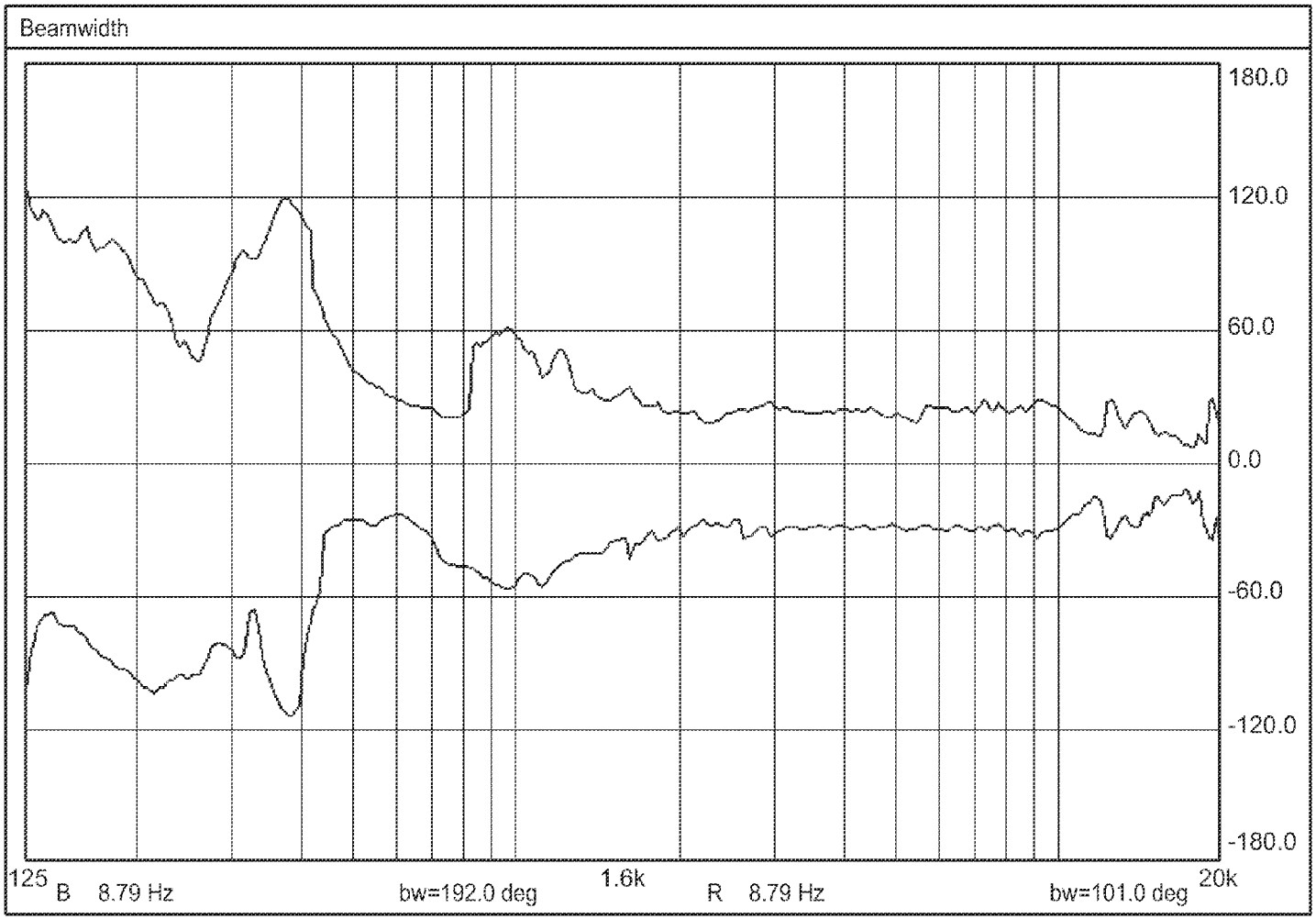
FIG. 5 is a graph of the improved vertical beamwidth of a loudspeaker in accordance with the present invention using the exemplary waveguide horn shown in FIGS. 2A-2C, and which includes a signal processing circuit including crossover circuit portions, and demonstrating extended beamwidth control from 500 to 800 Hz.

In the present invention the low driver is made to operate together with the high horn loaded driver with signal processing below the normal cut-off frequency of 1.5 kHz to obtain extended vertical beamwidth control. FIG. 5 shows the graph of the measured vertical beamwidth versus frequency of the entire exemplary loudspeaker system having the characteristics and dimensions mentioned above and including signal processing. As seen in this graph, the vertical beamwidth is reduced to approximately 50 degrees from 800 Hz to 500 Hz. This is achieved by the signal processing described below, which creates a particular phase and magnitude relationship between the high channel and low channel that results in a narrower vertical beamwidth in regions below the horn's normal cut-off frequency. (As seen in FIG. 5, in the exemplary loudspeaker the beamwidth is not substantially improved in the region of 900 Hz to 1.5 kHz; however, it is contemplated that more powerful signal processing could be applied to produce a nearly arbitrary phase shift at all frequencies which would allow similar beamwidth control from 900 Hz to 1.5 kHz.)

Figure 7:
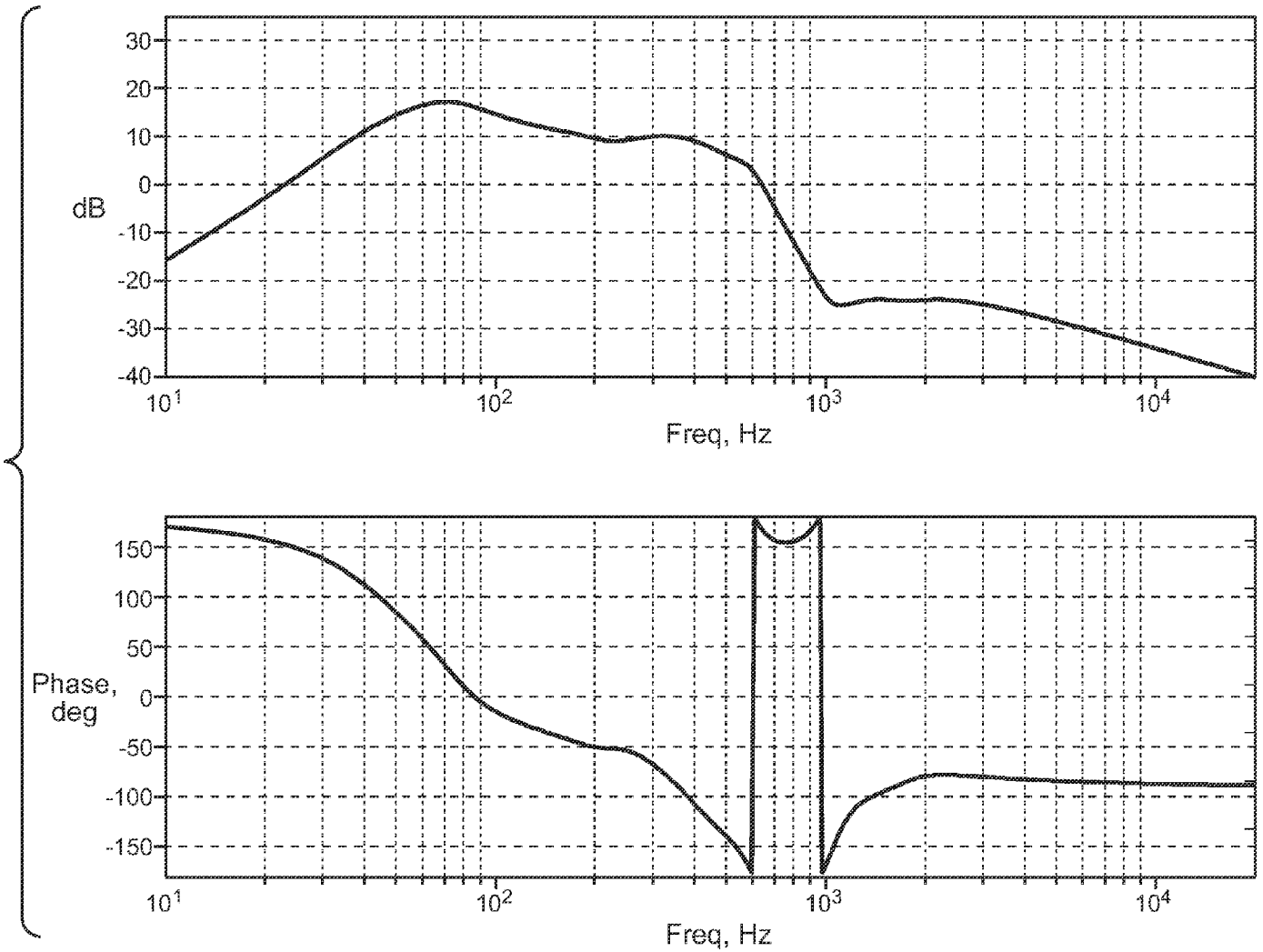
FIG. 7 is a graph of the electronic amplitude and phase response of the low channel signal processing of an exemplary two-way loudspeaker in accordance with the present invention.
Figure 8:
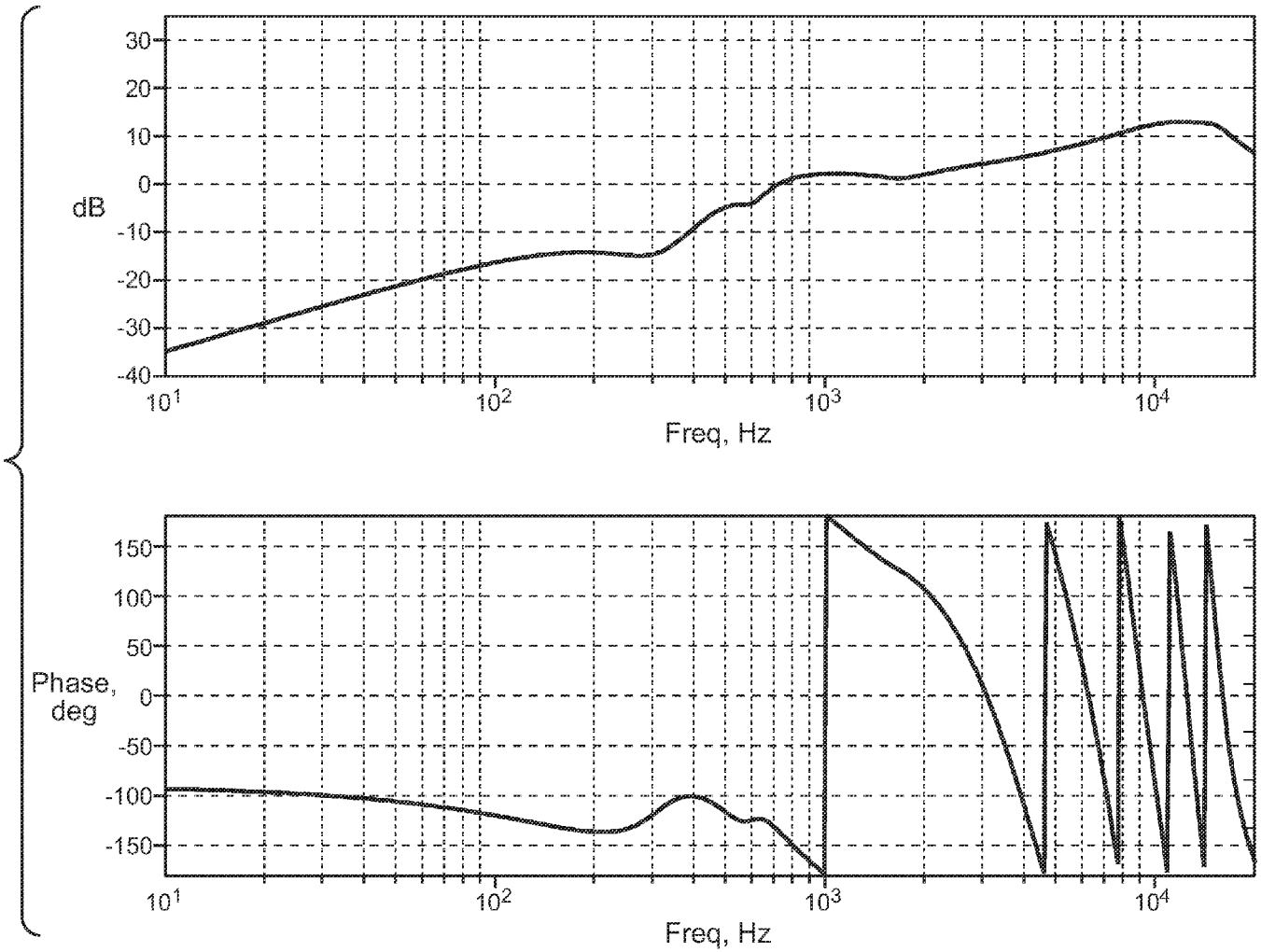
FIG. 8 is a graph of the electronic amplitude and phase of the high channel signal processing of an exemplary two-way loudspeaker in accordance with the present invention.
Figure 9:
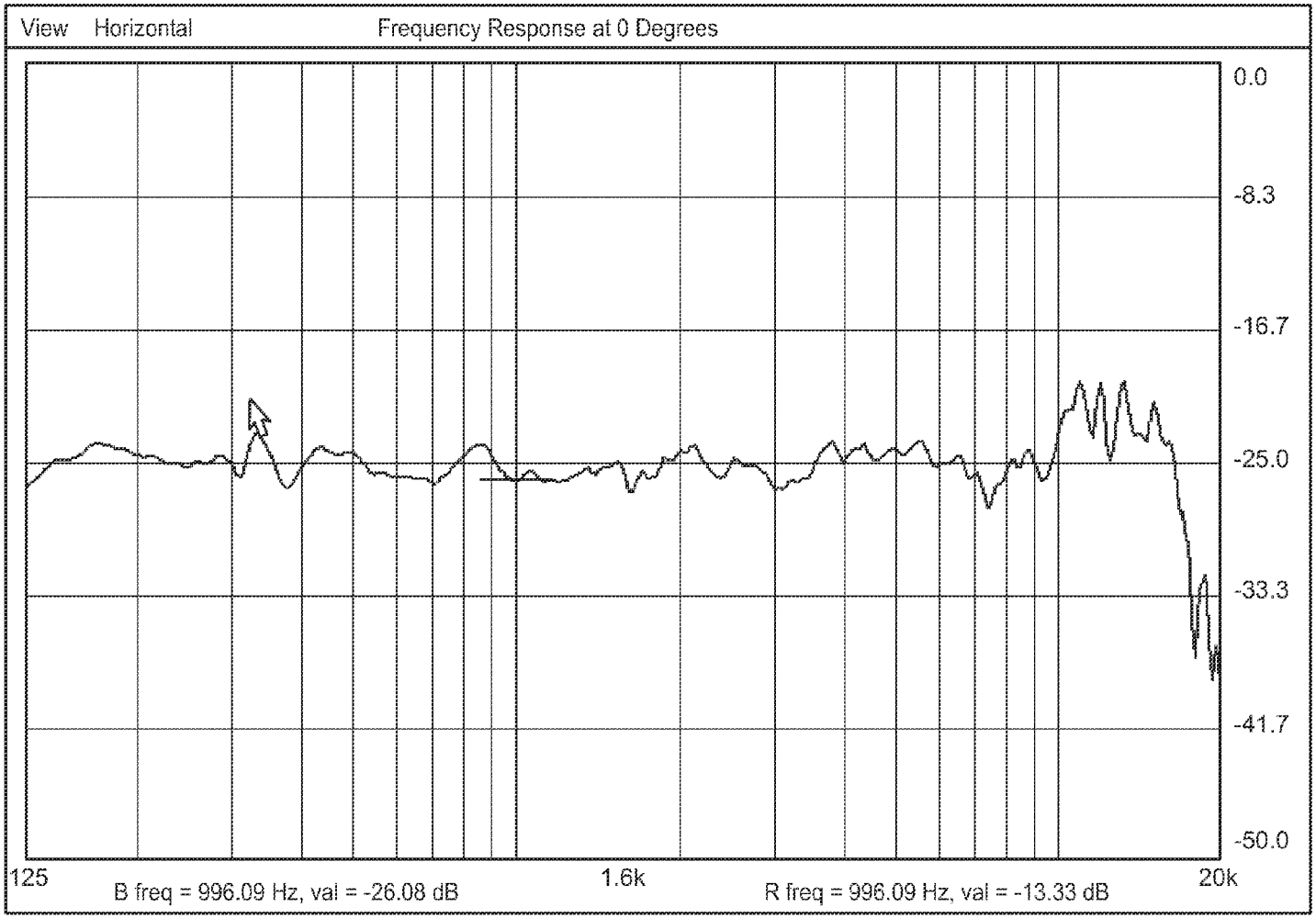
FIG. 9 is a graph of the acoustic frequency response of the complete loudspeaker of an exemplary two-way loudspeaker in accordance with the present invention.

The relationship between the phase and magnitude for the high channel and low channel of the exemplary loudspeaker system can be seen by FIGS. 7 and 8. The graph in FIG. 7 shows the amplitude and phase response produced by the signal processing circuit described below applied to the low channel of the loudspeaker system. The graph in FIG. 8 shows the amplitude and phase response of the signal processing applied to the high channel of the loudspeaker system.

Generally, the amplitude and phase response of both the low and high channels can be created by various combinations of filters and signal processing. A loudspeaker in accordance with the invention will function as intended as long as a magnitude and phase relationship between the low and high frequency channels is achieved such as shown in FIGS. 7 and 8. Therefore, any method to produce the amplitude and phase relationship between the two channels can be used.

It is noted that the overall amplitude and phase shape of the low and high channels shown in FIGS. 7 and 8 includes equalization to produce an overall flat frequency response for the entire loudspeaker as further described below.

Figure 6A:
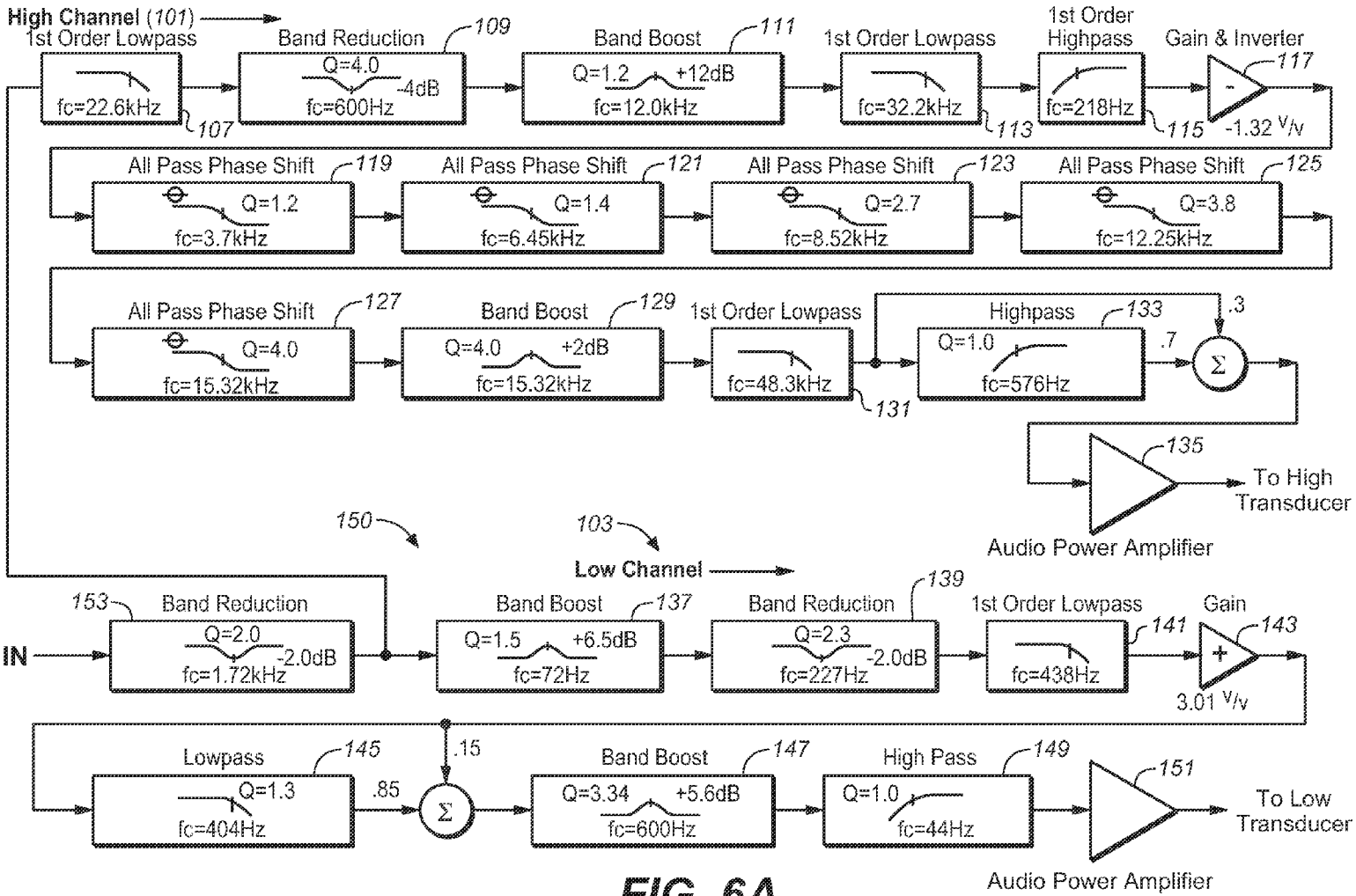
FIG. 6A is a functional block diagram of the signal processing circuit, including crossover circuit portions, of a 2-way loudspeaker in accordance with the invention.
Figure 6B:
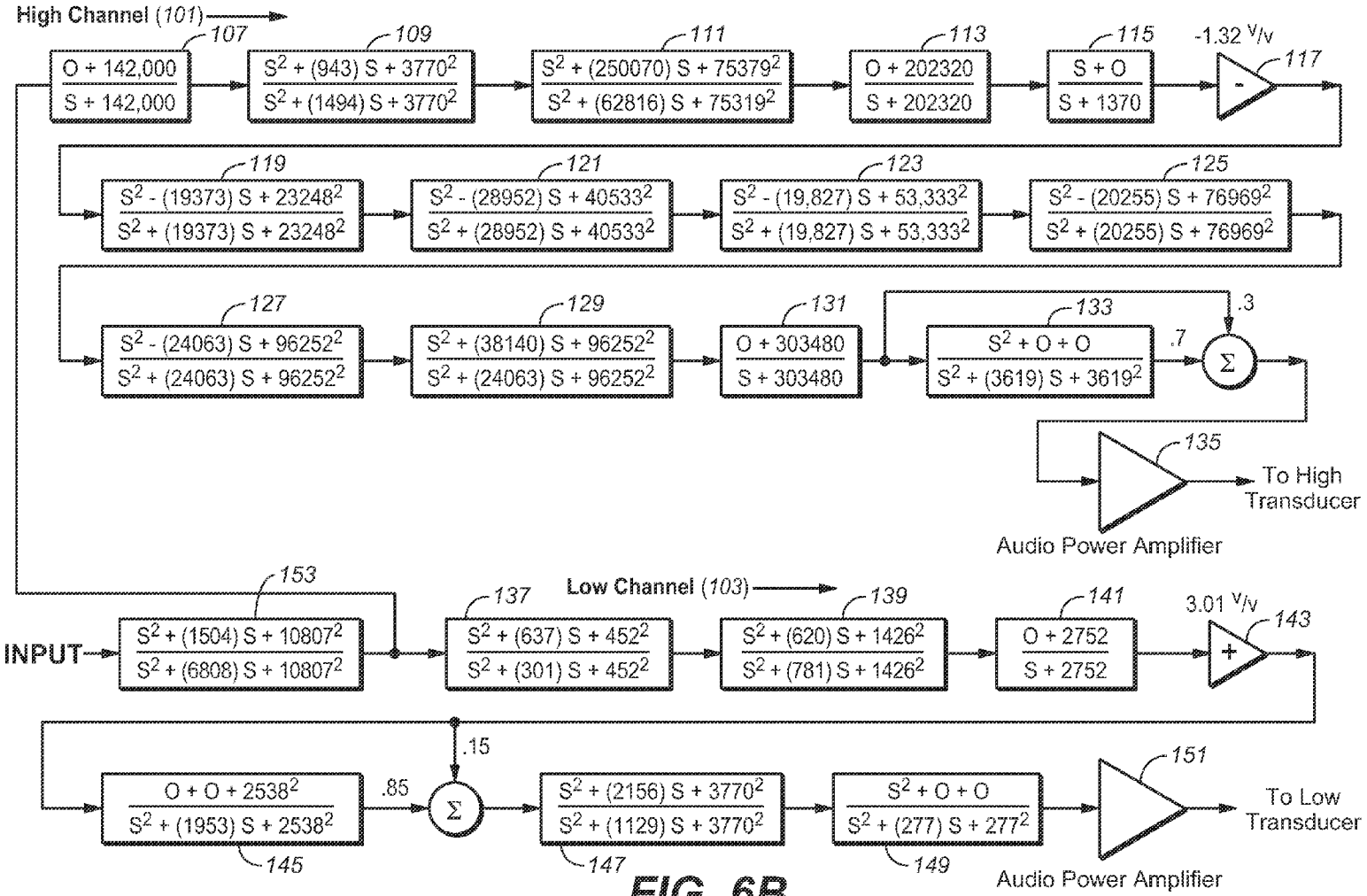
FIG. 6B is another functional block diagram thereof showing the transfer functions for each functional block of the signal processing circuit.

The exemplary signal processing system used to produce the vertical beamwidth control shown in FIG. 5 and the magnitude and phase relationships between the low and high frequency channels shown in FIGS. 7 and 8 is described with reference to FIGS. 6A and 6B. FIGS. 6A and 6B show a signal processing circuit having a high frequency channel 101 and a low frequency channel 103. The functional blocks (circuit portions) of the circuit are the same in each figure, but for illustrative purposes the information in the functional blocks in each figure are presented in a different form. In FIG. 6A the functional blocks are shown with a description and graphic depiction of its circuit functions; in FIG. 6B the mathematic transfer function for each circuit portion is shown. Generally, it is noted that some of the circuit portions (blocks) are standard "second order filters" as commonly practiced in signal processing. Higher order filters can be substituted in place of these second order filters.

Referring to FIGS. 6A and 6B, the high and low-pass channels 101, 103 of the illustrated signal processing circuit are seen to include circuit portions that, among other things, produce the cross-over function. The circuit portions that produce the cross-over include the first order high pass filter 115 and second order high pass filter 133 in the high channel and the first order low-pass filters 141 and second order low pass filter 145 in the low channel. In the high channel, high-pass filter 115 produces a low frequency cut-off at 218 Hz and the high-pass filter 133 produces a low frequency cut-off at 576 Hz. In the low channel low-pass filter 141 produces a high frequency cut-off at 438 Hz and the low-pass filter 145 produces a high frequency cut-off at 404 Hz. The combination of these distributed filters produce a cross-over frequency range from about 400 Hz to about 1.2 kHz. Also, the cumulative contributions of these first and second order filters to the magnitude and phase relationships between the low and high frequency channels within the cross-over frequency range affect the vertical beamwidth of the acoustic energy produced by the loudspeaker system. As a consequence, the vertical beamwidth can be controlled within this frequency region, thereby downwardly extending the frequency range where relatively constant vertical beamwidth can be achieved.

Other circuit portions (blocks) of the illustrated signal processing circuit perform equalization functions over the operating frequency range of the loudspeaker, including equalization within the cross-over region. In the high frequency channel, block 109 is a second order band reduction circuit portion for the cross-over region, which affects the bandwidth of the cross-over region. Blocks 111, 129 are second order band boost circuit portions for providing equalization at high frequencies. Blocks 113 and 131 are first order low pass circuit portions having high cut-off frequencies and are added to contribute cumulative phase shift. The all-pass circuit blocks 119, 121, 123, 125, 127 are added to restore transient response and don't affect bandwidth. The first order low-pass filter 107 at the front end of the high channel is added to roll-off high frequencies in the ultrasonic region above 20 kHz. Additional circuit portions in the high channel include inverting op amp with gain adjustment 117 before the all-pass filter 119, and the power amplifier 135 at the end of high channel 101.

The low frequency channel of the illustrated signal processing circuit additionally includes band boost and band reduction circuit portions 137, 139 to provide equalization at low frequencies. The band boost circuit section 147 is added to the low channel to produce equalization in the cross-over region and to balance the contribution between the high and low transducers to the overall acoustic response. The second order high-pass circuit section 149 simply rolls off the response at the low end of the operating frequency range. Other circuit portions in the low channel include the op amp 143 for providing gain added before low-pass filter 145 and the audio power amplifier 151 at the end of low channel 103.

It is seen the additional equalization can be provide at the input before the high and low frequency channels 101, 103, such as second order band reduction circuit portion 153.

While a specific embodiment of the invention has been described in considerable detail above specification and accompanying drawings, it is not intended that the invention be limited to such detail except as necessitated by the following claims.

We claim:

1. A loudspeaker system having an operating frequency range comprising a high frequency channel, a low frequency channel, a horn in said high frequency channel, said horn having and mouth end, a throat end, expansion walls between the throat end and mouth end, a center radiation axis, and an inherent cut-off frequency below which the horn by itself loses vertical beamwidth control, a high frequency transducer coupled to the throat end of said horn, a low frequency transducer in said low frequency channel, said low frequency transducer having a center and being positioned in spaced relation to the mouth end of said horn so that there is a defined separation between the center of said low frequency transducer and the center radiation axis of said horn, and a signal processing circuit, said signal processing circuit including a high frequency channel for driving the high frequency transducer coupled to said horn and defining in-part the high frequency channel of the loudspeaker system, and a low frequency channel for driving the low frequency transducer and defining in-part the low frequency channel of the loudspeaker system, said signal processing circuit having at least one first order and at least one second order cross-over circuit portion in the high frequency channel and in the low frequency channel thereof, said cross-over circuit portions combining to produce a cross-over frequency region below the cut-off frequency of said horn, such that the horn and low frequency transducer interact to contribute acoustic outputs within said cross-over frequency region to extend the operating frequency range of the horn below the inherent cut-off frequency of the horn, said signal processing circuit further having equalization circuit portions in the high frequency channel and in the low frequency channel thereof for equalizing the acoustic output of the loudspeaker system, including equalizing said acoustic output in the cross-over frequency region, the expansion walls of said horn being designed to provide relatively constant horizontal and vertical beamwidths within portions of the operating frequency range of the loudspeaker above the cross-over frequency range thereof, and portions of said signal processing circuit, including the cross-over circuit portions in the high and low frequency channels thereof, being designed to provide vertical beamwidth control of the acoustic output of the loudspeaker system within the cross-over frequency region thereof.

2. The loudspeaker system of claim 1 wherein said high frequency transducer is a compression driver.

3. The loudspeaker system of claim 1 wherein said low frequency transducer is a cone driver.

4. The loudspeaker system of claim 3 wherein said cone driver is a 15 inch cone driver and the separation between the center of said low frequency transducer and the center radiation axis of said horn is no greater than about 15 inches.

5. The loudspeaker system of claim 1 wherein the depth of said horn is no greater than about 10½ inches.

6. The loudspeaker system of claim 1 wherein the equalization circuit portion in the high frequency channel of said signal processing circuit includes at least one second order band boost circuit.

7. The loudspeaker system of claim 1 wherein said signal processing circuit further comprises at least one first order low pass circuit portion in the high frequency channel thereof, said first order low pass circuit portion having a high cut-off frequency and contributing to cumulative phase shift.

8. The loudspeaker system of claim 1 wherein said signal processing circuit further comprises at least one all-pass circuit in the high frequency channel thereof for restoring transient response.

9. The loudspeaker system of claim 1 wherein said signal processing circuit further comprises a first order low pass filter in the high frequency channel thereof for rolling off high frequencies in the ultrasonic audio frequency range.

10. The loudspeaker system of claim 1 wherein said signal processing circuit further comprises in the high frequency channel at least one second order band boost circuit portion in the high frequency channel thereof, at least one first order low pass circuit portion in the high frequency channel thereof, said first order low pass circuit portion having a high cut-off frequency and contributing to cumulative phase shift, and at least one all-pass circuit in the high frequency channel thereof for restoring transient response.

11. The loudspeaker system of claim 10 wherein said signal processing circuit further comprises a first order low pass filter in the high frequency channel thereof for rolling off high frequencies in the ultrasonic audio frequency range.

12. The loudspeaker system of claim 1 wherein the equalization circuit portion in the low frequency channel of the signal processing circuit includes a second order band boost circuit and second order band reduction circuit.

13. The loudspeaker system of claim 1 wherein the loudspeaker system has a cross-over region within its operating frequency range and wherein said signal processing circuit further comprises a band boost circuit section in the low frequency channel thereof to produce equalization in said cross-over region.

14. The loudspeaker system of claim 1 wherein said signal processing circuit further comprises a high pass circuit portion in the low frequency channel thereof for rolling off low frequencies at the low end of the operating frequency range of the loudspeaker system.

15. A loudspeaker system having an operating frequency range and a cross-over region within its operating frequency range, comprising:

a high frequency channel, a low frequency channel, a horn in said high frequency channel, said horn having and mouth end, a throat end, expansion walls between the throat end and mouth end, a center radiation axis, and an inherent cut-off frequency below which the horn by itself loses vertical beamwidth control, a high frequency transducer coupled to the throat end of said horn, a low frequency transducer in said low frequency channel, said low frequency transducer having a center and being positioned in spaced relation to the mouth end of said horn so that there is a defined separation between the center of said low frequency transducer and the center radiation axis of said horn, and a signal processing circuit, said signal processing circuit including a high frequency channel for driving the high frequency transducer coupled to said horn and defining in-part the high frequency channel of the loudspeaker system, and a low frequency channel for driving the low frequency transducer and defining in-part the low frequency channel of the loudspeaker system, said signal processing circuit having at least one first order and at least one second order cross-over circuit portion in the high frequency channel and in the low frequency channel thereof, said cross-over circuit portions combining to produce a cross-over frequency region below the cut-off frequency of said horn, such that the horn and the low frequency transducer interact to contribute acoustic outputs within said cross-over frequency region to extend the operating frequency range of the horn below the inherent cut-off frequency of the horn, the high frequency channel said signal processing circuit comprising at least one second order band boost circuit portion in the high frequency channel thereof, at least one first order low pass circuit portion in the high frequency channel thereof, said first order low pass circuit portion having a high cut-off frequency and contributing to cumulative phase shift, and at least one all-pass circuit in the high frequency channel thereof for restoring transient response, the low frequency channel said signal processing circuit comprising a second order band boost circuit and second order band reduction circuit, a band boost circuit section in the low frequency channel thereof to produce equalization in said cross-over region, and a high pass circuit portion in the low frequency channel thereof for rolling off low frequencies at the low end of the operating frequency range of the loudspeaker system, the expansion walls of said horn being designed to provide relatively constant horizontal and vertical beamwidths within portions of the operating frequency range of the loudspeaker above the cross-over frequency range thereof, and portions of said signal processing circuit, including the cross-over circuit portions in the high and low frequency channels thereof, being designed to provide vertical beamwidth control of the acoustic output of the loudspeaker system within the cross- over frequency region thereof.

16. A loudspeaker system having an operating frequency range and a cross-over region within its operating frequency range, comprising:

a high frequency channel, a low frequency channel, a horn in said high frequency channel, said horn having a mouth end, a throat end, expansion walls between the throat end and mouth end, a center radiation axis, and an inherent cut-off frequency below which the horn by itself loses vertical beamwidth control, a high frequency transducer coupled to the throat end of said horn, a low frequency transducer in said low frequency channel, said low frequency transducer having a center and being positioned in spaced relation to the mouth end of said horn so that there is a defined separation between the center of said low frequency transducer and the center radiation axis of said horn, and a signal processor, said signal processor including a high frequency channel for driving the high frequency transducer coupled to said horn and defining in- part the high frequency channel of the loudspeaker system, and a low frequency channel for driving the low frequency transducer and defining in-part the low frequency channel of the loudspeaker system, said signal processor having at least one first order and at least one second order cross-over portion in the high frequency channel and in the low frequency channel thereof, said cross-over portions combining to produce a cross-over frequency region below the cut-off frequency of said horn, such that the horn and the low frequency transducer interact to contribute acoustic outputs within said cross-over frequency region to extend the operating frequency range of the horn below the inherent cut-off frequency of the horn, said signal processor further having equalization portions in the high frequency channel and in the low frequency channel thereof for equalizing the acoustic output of the loudspeaker system, including equalizing said acoustic output in the cross-over frequency region.

17. The loudspeaker system of claim 16 wherein the expansion walls of said horn are designed to provide relatively constant horizontal and vertical beamwidths within portions of the operating frequency range of the loudspeaker above the cross- over frequency range thereof.

18. The loudspeaker system of claim 16 wherein portions of said signal processing circuit, including the cross-over circuit portions in the high and low frequency channels thereof, being designed to provide vertical beamwidth control of the acoustic output of the loudspeaker system within the cross-over frequency region thereof.

19. The loudspeaker system of claim 16 wherein the high frequency channel said signal processing circuit comprising at least at least one all-pass portion in the high frequency channel thereof for restoring transient response.

* * * * *

UNITED STATES PATENT AND TRADEMARK OFFICE

CERTIFICATE OF CORRECTION

PATENT NO. : 8,406,445 B1
APPLICATION NO. : 12/896363
DATED : March 26, 2013
INVENTOR(S) : Jon M. Arneson et al.

It is certified that error appears in the above-identified patent and that said Letters Patent is hereby corrected as shown below:

In the Specification
In column 2, line 18, --in-- should be inserted after "drawbacks."
In column 2, line 20, "cinemas" should read --cinema--.
In column 2, line 33, "affect" should read --effect--.
In column 2, line 56, "horns" should read --horn's--.
In column 3, line 4, "combined" should read --combine--.
In column 3, line 13, "space" should read --spaced--.
In column 3, line 25, "with by" should read --with the--.
In column 3, line 30, "with by" should read --with the--.
In column 4, line 34, --the-- should be inserted between "of" and "horn's."
In column 4, line 47, --be-- should be inserted after "they can."
In column 6, line 1, "horns" should read --horn's--.
In column 7, line 12, "produce" should read --produces--.
In column 7, line 53, --that-- should be inserted between "seen" and "the."
In column 7, line 53, "provide" should read --provided--.
In column 7, line 57, --in the-- should be inserted between "detail" and "above."

In the Claims
In column 7, line 66, "and" should read --a--.
In column 9, line 44, "and" should read --a--.
In column 10, line 7, "channel said" should read --channel of said--.
In column 10, line 16, "channel said" should read --channel of said--.
In column 12, line 8, "channel said" should read --channel of said--.
In column 12, line 9, "at least" should be deleted between "at least" and "one."

Signed and Sealed this
Tenth Day of December, 2013

Margaret A. Focarino

Margaret A. Focarino
*Commissioner for Patents of the United States Patent and Trademark Office*